US009648666B2

(12) United States Patent
Nomura et al.

(10) Patent No.: US 9,648,666 B2
(45) Date of Patent: May 9, 2017

(54) WARMING TEMPERATURE CONTROL DEVICE

(71) Applicant: Hongkong Tachibana Electronics Co., Ltd., Hong Kong (CN)

(72) Inventors: Takashi Nomura, Hong Kong (CN); Masahiro Asakura, Hong Kong (CN)

(73) Assignee: Hongkong Tachibana Electronics Co., Ltd., Hong Kong (CN)

( * ) Notice: Subject to any disclaimer, the term of this patent is extended or adjusted under 35 U.S.C. 154(b) by 0 days.

(21) Appl. No.: 14/972,819

(22) Filed: Dec. 17, 2015

(65) Prior Publication Data

US 2017/0006663 A1 Jan. 5, 2017

(30) Foreign Application Priority Data

Jul. 2, 2015 (JP) ..... 2015-133360

(51) Int. Cl.
*H05B 1/02* (2006.01)
*H05B 3/36* (2006.01)

(52) U.S. Cl.
CPC ..... *H05B 1/0205* (2013.01); *H05B 3/36* (2013.01)

(58) Field of Classification Search
CPC ..... H05B 1/0205; H05B 3/36; H05B 3/34; H05B 3/56; H05B 2203/02; H05B 2203/035
USPC ..... 219/212, 504, 505, 517, 490; 2/905
See application file for complete search history.

(56) References Cited

U.S. PATENT DOCUMENTS 4,547,658 A * 10/1985 Crowley ..... H05B 3/342 219/212
9,320,084 B2 * 4/2016 Weiss ..... H05B 3/146
9,519,017 B2 * 12/2016 Kohn ..... G01R 31/026
2001/0008236 A1 * 7/2001 Allard ..... H05B 1/0272 219/481
2003/0132212 A1 * 7/2003 Sowa ..... H05B 3/342 219/212
2003/0173345 A1 * 9/2003 Irwin, Sr. ..... H05B 1/0272 219/212

(Continued)

FOREIGN PATENT DOCUMENTS

JP S48-066480 A 9/1973
JP 02-098088 A 4/1990

(Continued)

*Primary Examiner* — Mark Paschall
(74) *Attorney, Agent, or Firm* — Venable LLP; Michael A. Sartori; F. Brock Riggs

(57) ABSTRACT

To provide a warming temperature control device which prevents overheating with high accuracy and stability to ensure safety and is excellent in economy, between both electrodes of a DC stabilization power supply which drives a temperature control section, a fixed resistor with which a capacitor is connected in parallel, a first diode disposed in a forward direction with respect to the power supply, and a temperature detection element wire are connected in series, and an inter-wire short circuit protection circuit is included. A degree of leak of a polymer layer is determined by detecting a difference between a maximum value and a minimum value of an input signal to the temperature control section on a time axis. When the difference increases to reach a predetermined set value, the temperature control section performs control such that a heating signal is not outputted.

4 Claims, 6 Drawing Sheets

Temperature Control Circuit of the Present Invention

(56) References Cited

U.S. PATENT DOCUMENTS

2010/0089898 A1* 4/2010 Lee ..... H05B 1/0272
219/212

FOREIGN PATENT DOCUMENTS

| | | | |
|---|---|---|---|
| JP | H03-100393 | U | 10/1991 |
| JP | 05-003071 | A | 1/1993 |
| JP | 05-306819 | A | 11/1993 |
| JP | 05-343169 | A | 12/1993 |
| JP | 06-005175 | A | 1/1994 |
| JP | 06-124771 | A | 5/1994 |
| JP | H06-038195 | U | 5/1994 |
| JP | 07-216174 | A | 8/1995 |
| JP | 2015-26458 | A | 2/2015 |
| WO | WO-99/30535 | A1 | 6/1999 |

* cited by examiner

Temperature Control Circuit of the Present Invention

General Cord-Like Heating Wire 1H
(Common to the Present Invention and Related Art)

Waveforms of Input Voltage and Load Current
in Leak between S2 and H2 Terminals

Temperature Control Circuit of Related Art

WARMING TEMPERATURE CONTROL DEVICE

FIELD OF THE INVENTION

The present invention relates to a warming temperature control device for use in a planar warming apparatus such as an electric blanket or an electric carpet.

BACKGROUND OF THE INVENTION

In general, a cord-like heating wire for use in a planar warming apparatus such as an electric blanket or an electric carpet has been hitherto well known. In particular, a cord-like heating wire used frequently in recent years has a configuration called a single-wire type cord-like heating wire in which a heating element wire and a detection element wire are integrated with each other, and the structure thereof is shown in FIG. 2.

The single-wire type cord-like heating wire 1H shown in FIG. 2 includes a winding core 1 composed of a fiber bundle of a polyester fiber or the like, a heating element wire 2 composed of a conductor which is made of copper or a copper alloy and twisted on the outer periphery of the winding core 1 in a spiral manner, a polymer layer 3 formed by extruding a polymer resin onto the outer periphery of the heating element wire 2, a temperature detection element wire 4 composed of a conductor which is made of nickel or the like and twisted on the outer periphery of the polymer layer 3 in a spiral manner, and an insulation coating layer 5 formed by extruding a polyvinyl chloride resin or the like onto the outermost periphery. According to needs, a polyester tape may be twisted in a spiral manner between the temperature detection element wire 4 and the insulation coating layer 5 to provide a barrier layer against shift of a plasticizer from the insulation coating layer 5. In addition, in some single-wire type cord-like heating wire, the heating element wire 2 and the temperature detection element wire 4 are reversely arranged.

In the cord-like heating wire 1H having such a structure, a temperature change due to heating changes the resistance value of the temperature detection element wire 4 made of nickel having a positive temperature coefficient, and the change is converted into an electric signal which is extracted and used for temperature control. Unlike a thermosensitive polymer layer caused to have temperature characteristics by using an ionic conductive agent or the like, the temperature detection element wire 4 composed of a nickel wire has a resistance value and a temperature coefficient which are low but have high accuracy and are stable, so that stable temperature control with high accuracy is achieved over a long period of time.

In the cord-like heating wire 1H, the polymer layer 3 has a unique melting point, and when the cord-like heating wire 1H enters an overheating state, the polymer layer 3 melts and serves as a so-called inter-wire short circuit protection functional material with which the heating element wire 2 and the temperature detection element wire 4 are in contact. This means that, in the single-wire type cord-like heating wire 1H, a control circuit is configured such that the heating element wire 2 and the temperature detection element wire 4 serve as a pair of electrodes which detect a short circuit. In addition, as the polymer layer 3, there is a thermosensitive polymer layer caused to a so-called negative temperature coefficient thermistor (hereinafter abbreviated as "thermistor") characteristic in which an impedance decreases with temperature rise, a temperature signal different from that of the temperature detection element wire 4 is obtained therefrom, and a control device having a function of preventing local overheating is also realized.

Operations of temperature control and inter-wire short circuit protection of the single-wire type cord-like heating wire 1H are achieved by a temperature control circuit shown in a related art example of FIG. 6. In the temperature control operation, a change in resistance of the temperature detection element wire 4 is divided by resistors R1 and R2, is inputted as a DC input voltage Vi to the minus terminal of a voltage comparator U1 via a smoothing circuit composed of R3 and C2, and is compared with a reference voltage Vref1 corresponding to a preset temperature. A result thereof is outputted from the output terminal of the voltage comparator U1 to drive a power control switch SW to open or close, whereby energization of the heating element wire 2 is controlled. Here, a rectifier diode D4, a voltage reduction resistor R4, an electrolytic capacitor C3, and a three-terminal regulator U2 are used for supplying a low-voltage DC stabilization power supply Vcc=5V to a temperature control section, and GND is a ground for the DC stabilization power supply. In addition, an H point and an N point of an AC power supply are names indicating positions on a circuit diagram and do not include electrical meanings.

For the inter-wire short circuit protection operation, the anodes of diodes D2 and D3 are connected to both ends of the temperature detection element wire 4, respectively, the cathodes of the diodes D2 and D3 are combined and connected to one end of a temperature fuse integral type resistor RF1, and the other end of the temperature fuse integral type resistor RF1 is connected to one end of AC 100 V. The role of D5 in a temperature control circuit diagram of FIG. 6 is to prevent a reverse current from flowing through the inter-wire short circuit protection circuit via the ground GND for the DC stabilization power supply of the temperature control circuit in the case where the N point side of the power supply has a positive cycle.

Here, when the temperature control section is broken to be uncontrollable, the power control switch SW is kept ON to continue energization of the heating element wire 2, whereby the entirety enters an overheating state. Thus, the polymer layer 3 melts at its unique melting point, a short circuit occurs between the heating element wire 2 and the temperature detection element wire 4, a current flows through a path of "AC power supply N point→heating element wire 2→polymer layer 3→temperature detection element wire 4→D2 or D3→RF1→F1→AC power supply H point", the temperature fuse integral type resistor RF1 is heated, and the temperature fuse thereof is blown within a predetermined time period to disconnect the power supply, whereby a final protection circuit which prevents occurrence of a fire is formed.

When the polymer layer 3 has a thermistor characteristic and a function of detecting an AC impedance with respect to the temperature thereof to prevent local overheating is provided, this is achieved through the following means.

An overheat detection wire is wound on the polymer layer 3 independently of the temperature detection element wire 4. A change in AC impedance between the overheat detection wire and the heating element wire 2 is detected, is inputted to a voltage comparator other than the voltage comparator U1, and is compared with a reference value Vref2 which is set in addition to Vref1. The power control switch SW is driven to open or close based on a result thereof, whereby energization of the heating element wire 2 is controlled.

A temperature signal from the temperature detection element wire 2 is switched between for temperature detection and for overheat detection in a time-division manner by hardware means called a control circuit. The respective signals are inputted to different voltage comparators for temperature control and for overheat prevention, and are compared with reference values for the respective signals. The power control switch SW is driven to open or close based on a result thereof, whereby energization of the heating element wire 2 is controlled.

As described above, the warming temperature control device using the existing single-wire type cord-like heating wire has not only a temperature control function but also a safety protection function, and is configured as a temperature control device whose safety is ensured in terms of configuration.

There are the following related arts for appearance and configuration which are similar as in the above description: JP S48(1973)-066480(A); JP H02(1990)-098088(A); JU H03(1991)-100393(A); JP H05(1993)-003071(A); JP H05(1993)-343169(A); JP H05(1993)-306819(A); JP H06(1994)-005175(A); JP H06(1994)-124771(A); JU H06(1994)-038195(A); JP H07(1995)-216174(A); WO 99/30535; and JP 2015-026458(A).

In recent years, regarding an electric carpet, while the area has been increased, there is a strong market demand for cost decrease by decreasing the wiring density of a cord-like heating wire per unit area. Thus, although an operation with a high watt density of a heating wire becomes common to increase a probability of local overheating, mounting of a local overheating prevention circuit using a negative temperature coefficient thermistor is avoided due to such a local overheating prevention circuit leading to great cost increases or due to limitations by a patent. Thus, products having mounted thereon only a low-cost inter-wire short circuit protection function whose detection capability for local overheating is originally not high flood, so that a temperature control device exposes poor performance, occurrence of an overheating color change or a one-coin-like scorch in a carpet due to local overheating increases, and a risk of a fire is pointed out, which has been a big problem.

A reason why it is not possible to provide an overheating prevention-equipped temperature control device using the above-described thermistor, at low cost is that a process of occurrence of local overheating has been not clear. This point is analyzed in JP 2015-026458(A) which is another application by the present inventors. Here, its outline will be described based on the temperature control circuit diagram of FIG. 6. When the temperature becomes a high temperature exceeding 100° C. as in local overheating, the polymer layer 3 of the single-wire type cord-like heating wire 1H exhibits a decrease in AC impedance close to a thermistor with temperature rise, particularly, even without adding a special additive such as an ionic conductive agent to impart a thermistor characteristic in the case where the material is a polyamide resin, and a leak current flows between the heating element wire 2 and the temperature detection element wire 4 due to overheating, to change the voltage of the minus terminal of the voltage comparator U1, which may adversely affects the temperature control function.

Specifically, in the circuit diagram of FIG. 6, three leak positions, a position between S1 and H1 terminals, a position between the heating element wire 2 at a center portion of the cord-like heating wire 1H and the temperature detection element wire 4, a position between S2 and H2 terminals, are set as parameters, and a relationship between a leak resistance Rx and the input voltage Vi is shown in FIG. 7 obtained by referring to JP 2015-026458(A).

According to FIG. 7, (1) in the case where a leak position is the S1 and H1 terminals side with respect to the center portion, as the leak resistance Rx due to overheating decreases so that a leak current increases, the voltage Vi inputted to the minus terminal of the voltage comparator U1 increases as compared to the case of no leak, and temperature control works such that the output of the voltage comparator U1 becomes OFF at a temperature lower than a set temperature. Thus, the temperature control has high safety; and (2) in the case where a leak position closer to the S2-H2 side than to the center portion, as the leak resistance Rx due to overheating decreases so that a leak current increases, the voltage Vi inputted to the minus terminal of the voltage comparator U1 decreases as compared to the case of no leak, and temperature control works such that the output of the voltage comparator U1 becomes OFF at a temperature higher than the set temperature. Thus, the leak current tends to increase, so that a dangerous state leading to overheating is likely to occur.

As described above, in the existing temperature control circuit shown in the temperature control circuit diagram of FIG. 6, in a state where the power control switch SW is ON so that the single-wire type cord-like heating wire 1H is heated, local overheating occurs in a region having a positional characteristic near the S2 and H2 terminals. If a leak current flows through the polymer layer 3 between the heating element wire 2 and the temperature detection element wire 4 of the cord-like heating wire 1H, the leak current decreases the input voltage of the minus terminal of the voltage comparator U1, and acts such that the temperature control output does not become OFF, and positive feedback works so as to further increase the temperature of local heating, which is pointed out to be very dangerous in terms of safety.

For such a problem, in JP H06(1994)-124771(A) and JU H06(1994)-038195(A), a temperature detection element wire and an overheating detection element wire are independently provided. A temperature signal and an overheating signal by a thermistor are separately detected, are inputted to different voltage comparators, and are used for temperature control or overheating prevention. However, there is a drawback that the cord-like heating wire and the temperature control circuit become complicated and cannot be economically provided at low cost.

In addition, in JP H05(1993)-003071(A), the cord-like heating wire has a thermistor function but does not have an overheating detection element wire. A temperature signal included in the temperature detection element wire and an overheating signal by the thermistor are temporally separated and detected through alternate switching of circuit connection by a plurality of transistors. These signals are inputted to different voltage comparators and used for temperature control and overheating prevention. However, in a region where the temperature of the thermistor is low and the impedance is high, there is a drawback that a signal current is low and it is not possible to ensure stable switching operation and detection operation. Also, there is a drawback that the temperature control circuit becomes complicated and cannot be economically provided at low cost.

Further, in WO 99/30535, the cord-like heating wire has a thermistor function but does not have an overheating detection element wire. A temperature signal included in the temperature detection element wire and an overheating signal by the thermistor are temporally separated and detected through division of a path for current in a positive cycle and a negative cycle of an AC power supply by a plurality of diodes. These signals are inputted to different voltage comparators and used for temperature control and overheating prevention, so that both functions are achieved by very simple and economical means. However, there is a drawback that in a region where leak of the thermistor is small, a signal voltage is buried due to insertion loss of a diode, or a signal voltage drifts due to temperature dependency of the diode, so that it is not possible to ensure stable detection operation with high accuracy. In addition, in the above four related arts, there is no description that the leak resistance increases or decreases the input voltage to the voltage comparator depending on the leak occurrence position, and thus it is hard to say that it is effective overheating prevention for all modes of leak occurrence, which is a drawback.

SUMMARY OF THE INVENTION

An object of the present invention is to provide a warming temperature control device that, even when leak occurs at any position in the polymer layer 3 of the single-wire type cord-like heating wire 1H, inputs an overheating signal and a temperature signal included in the temperature detection element wire 4 to a voltage comparator as they are, without processing these signals, determines these signals within the voltage comparator, and performs control such that a heating signal is not outputted from the output terminal of the voltage comparator when overheating occurs, so that ambiguous overheating prevention with low accuracy is not achieved unlike the above four related arts, and so prevents overheating by economical means with high accuracy to ensure safety.

In order to achieve the above-described object, a warming temperature control device according to a first aspect of the present invention is characterized in that a warming temperature control device having a cord-like heating structure comprising: a first wire which is wound spirally on a winding core at a predetermined pitch; a polymer layer which is disposed on the first wire in a close-contact manner and melts at a predetermined temperature; a second wire which is wound spirally on an outer periphery of the polymer layer at a predetermined pitch; and a coating layer which insulates the second wire, wherein one of the first and second wires is composed of a heating element wire, and the other of the first and second wires is composed of a temperature detection element wire; between both electrodes of a DC stabilization power supply which drives a temperature control section, a fixed resistor with which a capacitor is connected in parallel, a first diode disposed in a forward direction relative to the power supply, and the temperature detection element wire are connected in series; anodes of second and third diodes are connected to both ends of the temperature detection element wire, respectively; cathodes of the second and third diodes are connected to one end of a temperature fuse integral type resistor; another end of the temperature fuse integral type resistor is connected to one side of an AC power supply; a voltage of a connection point between a cathode of the first diode and the temperature detection element wire is inputted as an input signal to a voltage comparator; a degree of leak of the polymer layer is determined by detecting a difference between a maximum value and a minimum value of the input signal on a time axis; and when the difference increases to reach a predetermined set value, the temperature control section performs control such that a heating signal is not outputted to prevent overheating to ensure safety.

According to a second aspect of the present invention, in the warming temperature control device according to the first aspect, the polymer layer may be formed of only a polyamide resin or a mixture of a polyamide resin and polyamide elastomer and may have a melting temperature of not lower than 130° C. and not higher than 190° C.

According to a third aspect of the present invention, in the warming temperature control device according to the first aspect, the temperature detection element wire may be a metal wire having a positive temperature coefficient.

According to a fourth aspect of the present invention, in the warming temperature control device according to the second aspect, the temperature detection element wire may be a metal wire having a positive temperature coefficient.

The configuration of the present invention will be described below in detail. First, the first wire which is wound spirally on the winding core at the predetermined pitch is referred to as a heating element wire, and the second wire which is wound spirally on the outer periphery of the polymer layer at the predetermined pitch is referred to as a temperature detection element wire, but these wires may be reversely arranged.

A core wire used in the warming temperature control device according to the present invention is a polyester fiber bundle, an aramid fiber bundle, a glass fiber bundle, or the like. A polyester fiber bundle is preferable in terms of heat resistance, flexibility, and cost, and the core wire is not particularly limited as long as it is excellent in heat resistance and flexibility in accordance with a use application, or the core wire may be a mixed bundle of multiple types of fibers.

The heating element wire which is used in the warming temperature control device according to the present invention and wound spirally at the predetermined pitch is, for example, a pure copper wire, a copper-tin alloy wire, a copper-silver alloy wire, or the like as a material. The shape thereof may be a round wire shape or a thin plate shape. They are used as a single wire as it is, are made into a twisted wire, or are paralleled into multiple wires and wound spirally. However, selections of the material and the shape are not limited in any manner in order to obtain a predetermined resistance value with a predetermined dimension.

In the temperature control section used in the warming temperature control device according to the present invention, since the capacitor is connected in parallel with the fixed resistor between both electrodes of the DC stabilization power supply and the diode is disposed between the fixed resistor and the temperature detection element wire in the forward direction with respect to the DC stabilization power supply, the input voltage to the voltage comparator is stabilized, and this makes it possible to stably determine a temperature signal and an overheating signal within the voltage comparator.

An inter-wire short circuit protection circuit which includes the temperature fuse integral type resistor and the second and third diodes connected to both ends of the temperature detection element wire also serves to provide a stable potential to the AC power supply of the input voltage to the voltage comparator when leak occurs before a short circuit of the polymer layer, and is also another element which allows for stable determination.

Even when, among the components connected between both electrodes of the DC stabilization power supply which drives the temperature control section, the fixed resistor with which the capacitor is connected in parallel and the first diode are interchanged with each other in connection order, the input voltage does not change if the input signal to the voltage comparator is taken from the connection point between the temperature detection element wire and the fixed resistor.

Regarding a power switch which opens and closes energization of the heating element wire, even when a relay or triac is used for AC full wave and a thyristor is used for AC half wave, an operation mode of the present invention does not change. As a matter of course, symmetry is maintained if the positions of the components at the AC power supply and the connection directions thereof are reversed with respect to the AC power supply.

In the related art, when leak occurs between wires, in order to prevent noise or instability caused due to presence of AC and DC signals which are a temperature signal and an overheating signal, both signals are combined and inputted as a DC voltage to a voltage comparator via a smoothing circuit having a high time constant. Thus, as in JP H05 (1993)-003071(A) and WO 99/30535, the temperature signal and the overheating signal have to be switched and separated by hardware means called a control circuit at a stage previous to input to the voltage comparator, and to be determined by different voltage comparators.

The polymer layer used in the warming temperature control device according to the present invention is preferably a polyamide resin having a melting temperature of the polymer layer of not lower than 130° C. and not higher than 190° C., and more preferably a mixture of a polyamide resin and a polyamide elastomer which has a melting temperature of the polymer layer of 150° C. to 170° C. and exhibits a relatively steep melting characteristic, in view of the surface temperature of a product such as an electric blanket or an electric carpet, the heat resistant temperature of the cord-like heating wire, and the heating temperature of the heating element wire.

Here, if the melting temperature of the polymer layer is equal to or lower than 130° C., the peak temperature of the heating element wire instantaneously rises to around 120° C. in normal temperature control in some cases. If this repeatedly occurs, a possibility increases that a short circuit occurs between the heating element wire and the short circuit detection element wire in a short time period. If the melting temperature of the polymer layer is equal to or higher than 190° C., overheating of the heating element wire proceeds to increases occurrence of fuming or a scorch, which is not appropriate.

Various conductive agents such as a polyalkylene oxide may be added to the polymer layer, which is used in the warming temperature control device according to the present invention and is formed of only a polyamide resin or a mixture of a polyamide resin and a polyamide elastomer, to cause the polymer layer to have a so-called negative temperature coefficient thermistor characteristic in which an electric impedance decreases with adjustment of the melting temperature or temperature rise.

The temperature detection element wire which is used in the warming temperature control device according to the present invention is not particularly limited as long as it is a metal wire having a positive temperature coefficient. However, the temperature detection element wire is a temperature detection element wire in which nickel, which has a relatively high temperature coefficient among metals and whose resistance value or temperature coefficient is stable even when being subjected to mechanical stress such as wire drawing or wire winding, is used, and which has a positive temperature coefficient, has a linear resistance characteristic with respect to temperature, is excellent in reproducibility and less changes over time.

As the coating layer used in the warming temperature control device according to the present invention, an insulation coating layer, which is in close contact with the outer periphery of the temperature detection element wire, has a high electric insulating property, and is composed of a flexible and low-cost polyvinyl chloride resin or the like, is formed by extrusion or the like.

In the warming temperature control device according to the present invention, between both electrodes of a DC stabilization power supply which drives a temperature control section, a fixed resistor with which a capacitor is connected in parallel, a first diode disposed in a forward direction relative to the power supply, and the temperature detection element wire are connected in series; anodes of second and third diodes are connected to both ends of the temperature detection element wire, respectively; cathodes of the second and third diodes are connected to one end of a temperature fuse integral type resistor; another end of the temperature fuse integral type resistor is connected to one side of an AC power supply; a voltage of a connection point between a cathode of the first diode and the temperature detection element wire is inputted as an input signal to a voltage comparator; a degree of leak of the polymer layer is determined by detecting a difference between a maximum value and a minimum value of the input signal on a time axis; and when the difference increases to reach a predetermined set value, control is performed such that a heating signal is not outputted from an output terminal of the voltage comparator. Thus, overheating is prevented to ensure safety.

In the warming temperature control device according to the present invention, since the polymer layer is formed of a polyamide resin having a melting temperature of the polymer layer of not lower than 130° C. and not higher than 190° C., and is preferably formed of a mixture of a polyamide resin and a polyamide elastomer which has a melting temperature of the polymer layer of 150° C. to 170° C. and exhibits a relatively steep melting characteristic, it is possible to flexibly ensure an overall inter-wire short circuit protection function by selecting an appropriate type and formulation for the melting temperature and the melting time.

In the warming temperature control device according to the present invention, since the temperature detection element wire is a metal wire having a positive temperature coefficient, the temperature coefficient is low, but the resistance characteristic with respect to temperature is linear, and change over time is very small as compared to the polymer layer. Thus, precise and stable temperature control which is excellent in reproducibility is enabled.

Figure 4:
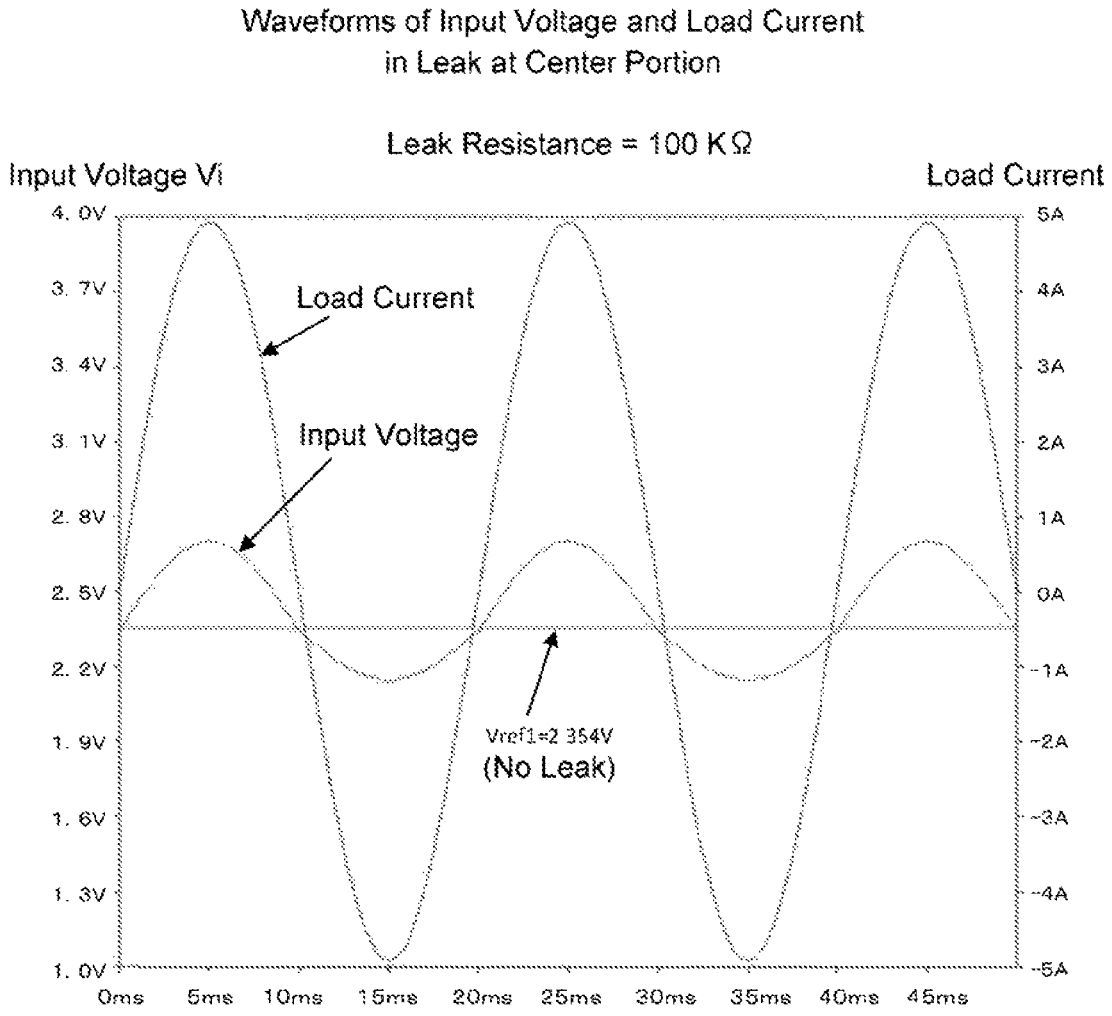
Figure 5:
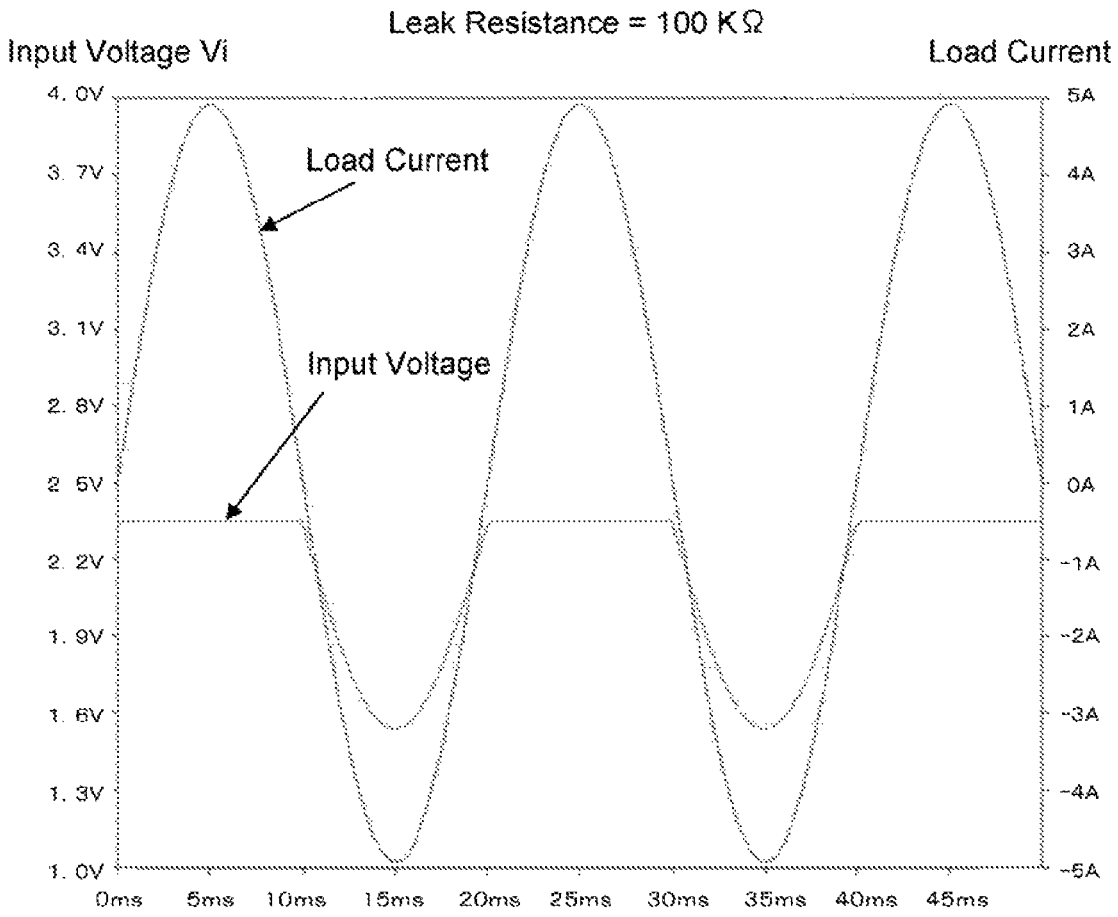
Figure 6:
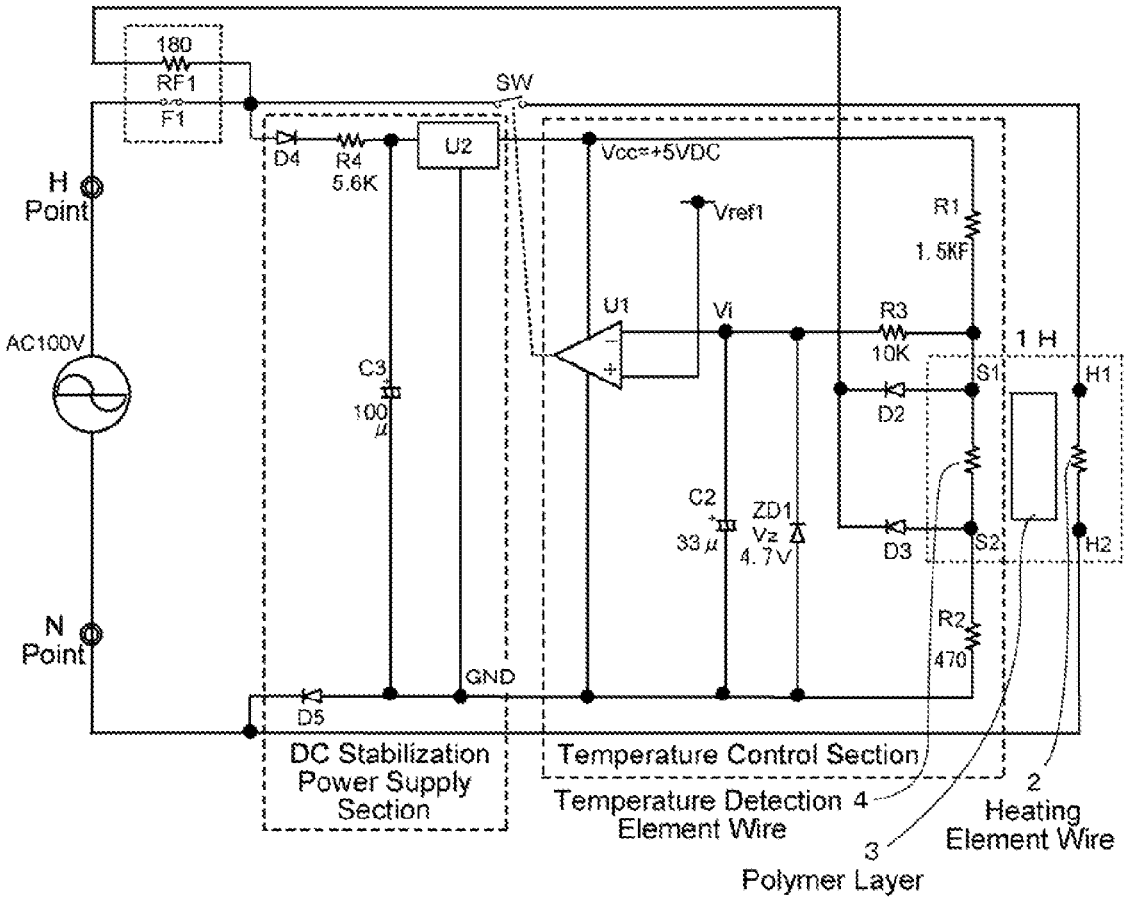
Figure 7:
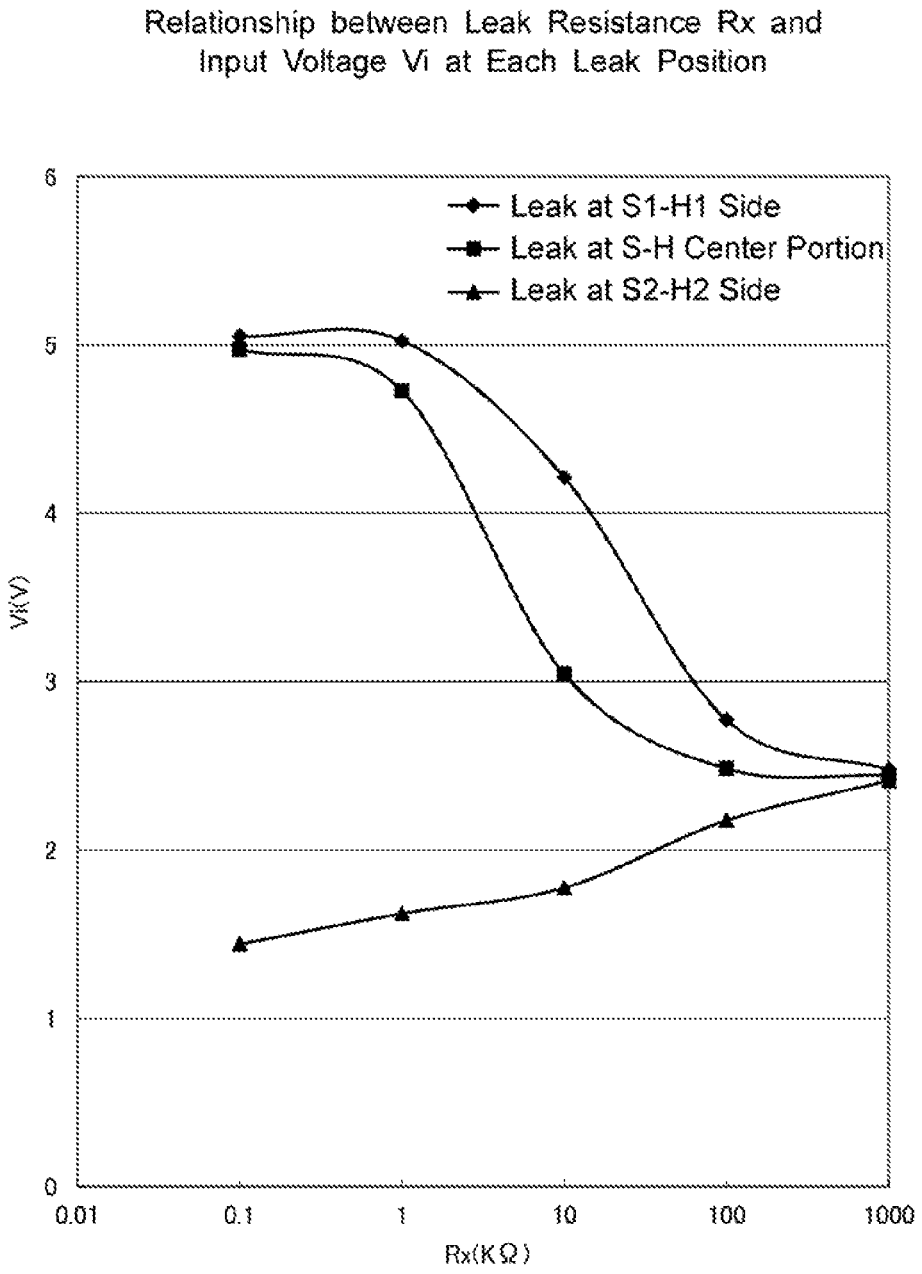

FIG. 4 is a diagram showing the phase of the load current Ih and the phase of the input voltage Vi inputted to the AD conversion port AD1 of the microcomputer U1 when the power control switch is ON, a leak position is at a center portion of the cord-like heating wire, and a leak resistance Rx is 100 KΩ in the warming temperature control device according to the present invention;

FIG. 5 is a diagram showing the phase of the load current Ih and the phase of the input voltage Vi inputted to the AD conversion port AD1 of the microcomputer U1 when the power control switch is ON, a leak position is at an S2 and H2 terminals, and a leak resistance is 100 KΩ in the warming temperature control device according to the present invention;

FIG. 6 is a circuit diagram showing an example of a temperature control circuit of a warming temperature control device according to a related art; and FIG. 7 is a diagram showing a relationship between a leak resistance Rx and an input voltage Vi inputted to a minus terminal of a voltage comparator U1 with a leak position as a parameter when a power control switch is ON in the warming temperature control device according to the related art.

DESCRIPTION OF THE PREFERRED EMBODIMENTS

Embodiments of a warming temperature control device according to the present invention will be described below in more detail with reference to the drawings and the like. The present invention is not limited to the following contents unless departing from the gist of the present invention.

Figure 2:
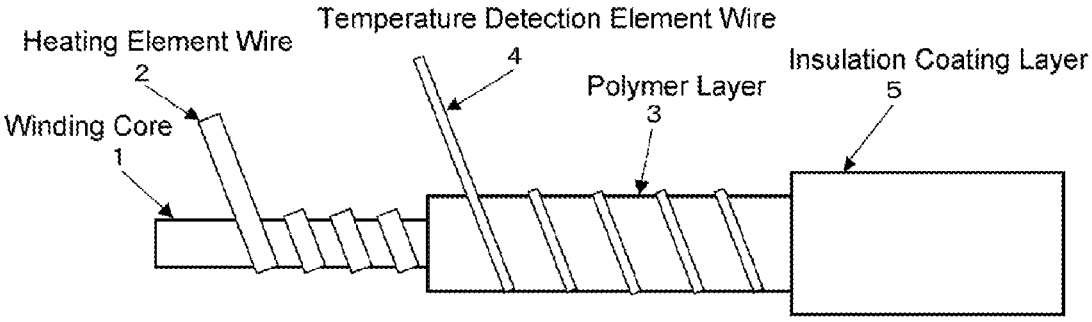
FIG. 2 is a structure diagram showing an embodiment of the warming temperature control device according to the present invention, wherein a part of a cord-like heating wire is omitted.

FIG. 2 is a diagram showing one end of a cord-like heating wire 1H according to an embodiment of the present invention, wherein an insulation coating layer, a polymer layer and the like are partially omitted, and the cord-like heating wire 1H has the same configuration as described in the above-described related art.

The cord-like heating wire 1H includes a winding core 1 composed of a fiber bundle of glass fiber, polyester fiber or the like, a heating element wire 2 composed of a rectangular conductor which is made of copper or a copper alloy and twisted on the outer periphery of the winding core 1 in a spiral manner, a polymer layer 3 formed by extruding a polymer resin onto the outer periphery of the heating element wire 2, a temperature detection element wire 4 wound spirally on the outer periphery of the polymer layer 3, and an insulation coating layer 5 formed by extruding a polyvinyl chloride resin or the like onto the outermost periphery.

Here, as the polymer layer 3, nylon 12 which has a low water absorption among polyamide resins, or a mixture of nylon 12 and a polyamide elastomer is preferable. When the molding temperature for the insulation coating layer 5 is low, polyethylene glycol or a polyalkylene oxide such as polyethylene oxide may be added to the mixture to decrease the softening point of the polymer layer 3. These materials are kneaded with a kneader or a multi-screw extruder to obtain the polymer layer 3 as a mixture. These materials may be loaded at one time and kneaded, but may be loaded sequentially and kneaded over a plurality of times.

In order to prevent a plasticizer contained in a polyvinyl chloride resin mixture of the insulation coating layer 5 from shifting to the polymer layer 3, a barrier layer may be formed between the temperature detection element wire 4 and the insulation coating layer 5 by longitudinally lapping a polyester tape.

Various specific data regarding the embodiment shown in FIG. 2 are as follows:

Material of the winding core 1: polyester fiber bundle, ϕ0.44 mm

Material of the heating element wire 2: 0.7% tin-copper alloy

Dimensions of the heating element wire 2: cross section 0.060×0.420 mm (rectangular conductor), pitch 0.86 mm Material of the polymer layer 3: polyamide resin Dimensions of the polymer layer 3: thickness 0.33 mm Material of the temperature detection element wire 4: nickel Dimensions of the temperature detection element wire 4: cross-section diameter ϕ0.080 mm (round conductor), pitch 0.86 mm Material of the insulation coating layer 5: polyvinyl chloride resin mixture Dimensions of the insulation coating layer 5: thickness 0.4 mm.

(Commercially-available nylon 12 (3020X15, manufactured by UBE) which does not contain any additive for a thermistor is used as the polyamide resin, and a commercially-available mixture (VM-163, manufactured by APCO) for power supply electric wire, in which a polyvinyl chloride resin with a heat resistance grade is used, is used as the polyvinyl chloride resin mixture.)

The cord-like heating wire 1H having the structure shown in FIG. 2 is made through a spirally winding step and an extrusion step for each layer with the above respective materials, and is cut into a length of 36 m as a sample for measurement. In FIG. 2, the resistance value of the heating element wire 2, which is a component of the cord-like heating wire 1H having a total length of 36 m, is 28.6Ω, and the resistance value of the temperature detection element wire 4 is 1000Ω at 20° C. (its temperature coefficient is 0.44%/° C.).

Figure 1:
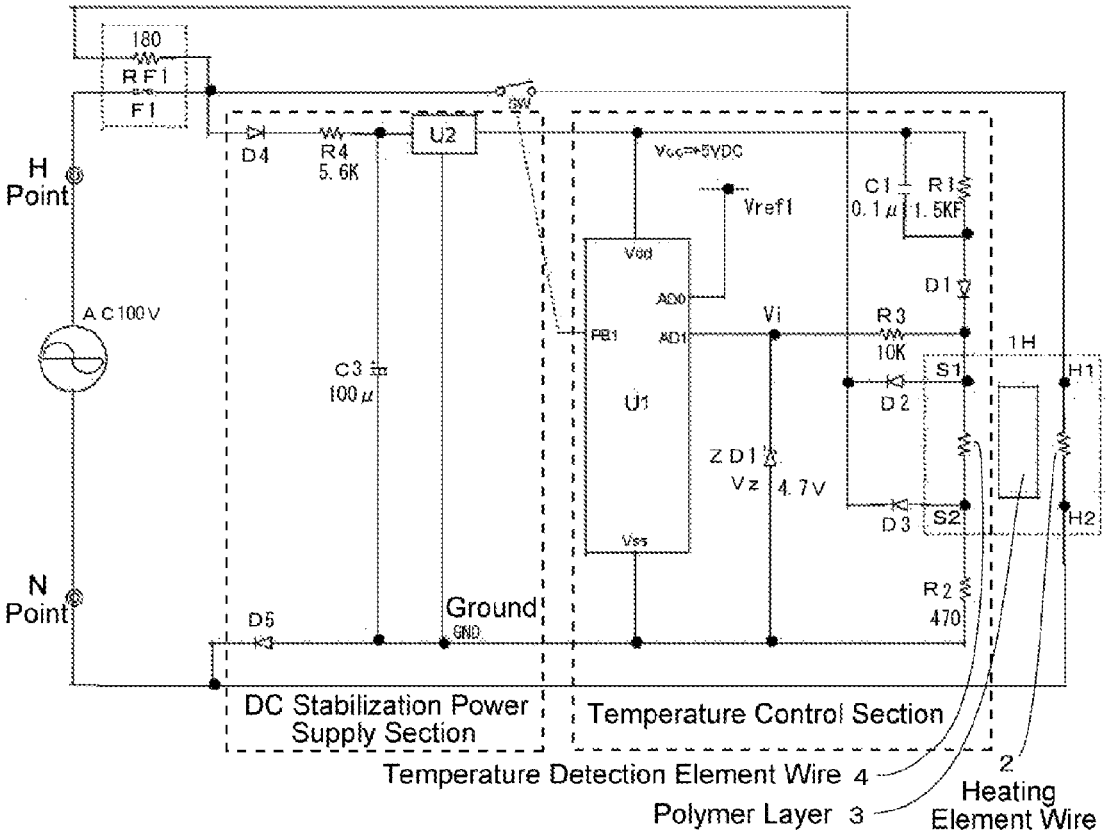
FIG. 1 is a circuit diagram showing an embodiment of a temperature control circuit of a warming temperature control device according to the present invention, wherein an AD converter and a processing section of a microcomputer serve as a voltage comparator.

The configuration of a temperature control circuit regarding the embodiment of the present invention is shown in FIG. 1, and electric values and operation of each component will be briefly described. R1, R2, R3 and R4 are fixed resistors, R1=1.5 KΩF, R2=470ΩF, R3=10 KΩ, and R4=5.6 KΩ, 3 W. C1 is a film capacitor, and C1=0.1 μF, 50 V. C3 is an electrolytic capacitor, and C3=100 μF, 35 V. D1, D2, D3, D4 and D5 are rectifier diodes 1N4004. ZD1 is a Zener diode, and Vz=4.7 V. U1 is a general-purpose one-chip flash type microcomputer equipped with an AD converter. U2 is a three-terminal regulator, and its output voltage is 5 V. GND is a ground for a DC stabilization power supply. SW is a power control switch which controls energization of the heating element wire 2 based on a comparison determination result of the microcomputer U1.

Operation of the circuit in FIG. 1 is as follows. In temperature control operation, a resistance change of the temperature detection element wire 4 is inputted as a temperature signal voltage from a connection point between the diode D1 and the temperature detection element wire 4 via the overvoltage prevention resistor R3 and the Zener diode ZD1 to an AD conversion port AD1 of the microcomputer U1 and stored in a RAM within the microcomputer U1. In the present embodiment, as a frequency of input to the AD converter, a single input per 1 mS is made consecutively 45 times, and the maximum value and the minimum value of 45 pieces of data and the difference therebetween are calculated and stored in the RAM. Here, since the speed of temperature rise or fall of the cord-like heating wire 1H is not so high, it is sufficient if an operation of input to the AD converter which takes 45 mS is performed at one time every about 10 seconds. The input time 45 mS which is one unit is very unlikely to hinder the other processes of the microcomputer U1.

If the difference ΔV between the maximum value and the minimum value of the AD conversion is lower than a set value, it is determined that there is no leak due to overheating, and the maximum value is regarded as a temperature signal and used for temperature control. In temperature control, the maximum value inputted to AD1 and Vref1 which is inputted and stored through an AD0 port as a voltage corresponding to a preset temperature are compared to each other by a processing section of the microcomputer U1, its determination result is outputted from an output port PB1, and the power control switch SW is driven to open or close based on the determination result, whereby energization of the heating element wire 2 is controlled. In overheating protection operation, if the difference ΔV between the maximum value and the minimum value inputted to AD1 is higher than the set value, it is determined that there is leak due to overheating. Its result is outputted from the output port PB1, and the power control switch SW is driven to be OFF based on the result, whereby energization of the heating element wire 2 is stopped.

The inter-wire short circuit protection operation is the same as the contents as described in the "BACKGROUND OF THE INVENTION" section.

[Leak Test]

The 36 m cord-like heating wire 1H is interposed and fixed between front and back fabrics such as felt by bonding to form an electric carpet heating element, and the ends of the heating element wire 2 are connected to H1 and H2 terminals shown in the temperature control circuit diagram in FIG. 1.

Instead of the temperature detection element wire 4, a 1200Ω fixed resistor (a resistance value corresponding to 65.5° C.) is connected between S1 and S2 terminals, and the temperature control set voltage Vref1 is set at 5V of Vcc and connected to the AD0 port of the microcomputer U1.

The temperature control circuit was connected to an AC power supply. After an initial stabilization time of 3 minutes elapsed, the input voltage Vi of the AD1 port of the microcomputer U1 was measured to obtain Vi=2.354 V, and this voltage was set as an input voltage Vis in the case of no leak.

Next, the 1200Ω fixed resistor was removed. Both ends of the temperature detection element wire 4 were connected to the S1 and S2 terminals. The temperature control set voltage Vref1 was set at 2.354 V and inputted to the AD0 port to obtain a state where the electric carpet was operable.

The electric carpet was connected to the AC power supply, and the power control switch SW was operated to be ON/OFF by the temperature control circuit to obtain a stable state.

While the input voltage Vi of the AD1 port of the microcomputer U1 was measured, a leak resistance of 1 KΩ was connected between the S1 and H1 terminals as a leak position at the time when the input voltage Vi of the port AD1 reached 2.354 V during a period when the power control switch SW was ON. After 5 seconds, a waveform of the input voltage Vi was observed with a digital oscilloscope to read the maximum value and the minimum value of the input voltage Vi.

By the same method, for the case with a leak resistance of 10 KΩ, 100 KΩ or 1000 KΩ, the maximum value and the minimum value of Vi were read.

Further, by the same method, for the case where a leak position was at the center portion of the cord-like heating wire 1H and the case where a leak position was between the S2 and H2 terminals, the maximum value and the minimum value of the input voltage Vi were read.

The obtained maximum values and minimum values of Vi and the differences ΔV therebetween are shown in Table 1.

The results of observation of the waveform of the input voltage Vi and a waveform Ih of a load current in the case with a leak resistance of 100 KΩ at each leak position described above are shown in FIGS. 3, 4, and 5.

TABLE 1

Input voltages and differences relative to leak resistance
C3 = 0.1 μF Power SW = ON

| Parameter | Leak resistance (KΩ) | Input voltage Vi (V) Max. | Input voltage Vi (V) Min. | Difference (V) ΔV | Average Vavg (V) | Waveform |
|---|---|---|---|---|---|---|
| No leak | ∞ | 2.354 | 2.346 | 0.008 | 2.351 | Ripple square wave |
| S1 and H1 terminals | 1000 | 2.469 | 2.347 | 0.122 | 2.385 | Upward half-wave |
| | 100 | 3.452 | 2.348 | 1.104 | 2.698 | Upward half-wave |
| | 10 | 4.721 | 2.351 | 2.370 | 3.418 | Upward round half-wave |
| | 1 | 4.871 | 2.357 | 2.514 | 3.556 | Upward round half-wave |
| Center portion | 1000 | 2.391 | 2.326 | 0.065 | 2.355 | Distortion sine wave |
| | 100 | 2.702 | 2.146 | 0.556 | 2.395 | Sine wave |
| | 10 | 4.573 | 1.127 | 3.446 | 2.703 | Round trapezoidal wave |
| | 1 | 4.801 | 1.069 | 3.732 | 2.859 | Substantially square wave |
| S2 and H2 terminals | 1000 | 2.355 | 2.262 | 0.093 | 2.323 | Downward half-wave |
| | 100 | 2.349 | 1.542 | 0.807 | 2.091 | Downward half-wave |
| | 10 | 2.319 | 1.004 | 1.315 | 1.708 | Downward round square wave |
| | 1 | 2.143 | 0.923 | 1.220 | 1.559 | Downward round square wave (whiskers at both ends) |
| | Criterion | >2.465 | <2.038 | >0.5 | | |

Table 1 shows the leak resistance Rx, the maximum value (Max) and the minimum value (Min) of the input voltage Vi inputted to the port AD1 of the microcomputer U1, and the differences (ΔV) therebetween with a leak position as a parameter when the power control switch SW is ON in the warming temperature control device according to the present invention.

[Local Overheating Test]

Similarly to the above [Leak Test], the temperature control set voltage Vref1 was set at 2.354 V (corresponding to 65.5° C.) and inputted to the AD0 port to obtain a state where the electric carpet was operating, and the surface temperature of the temperature-controlled cord-like heating wire 1H was measured. The measurement position was a position on the surface of the cord-like heating wire 1H away from the S2 and H2 terminals of the temperature control circuit by 1 m in wire distance, and a temperature sensor for direct measurement was fixed in contact with the position to measure a temperature. In the case of no local overheating, the result was 66° C.±2° C. Next, a 30 cm square insulating material having an excellent heat insulating function was put on the electric carpet so as to be centered at the temperature measurement point, and the temperature was measured. The result was 67° C.±2° C.

The evaluation of each measured value is as follows.

[Evaluation of Leak Test]

In occurrence of leak between the S1 and H1 terminals and at the center portion, when the maximum value of the input voltage Vi is used as a temperature control signal regardless of the value of the leak resistance Rx, it is possible to turn the power switch SW OFF at a low temperature lower than the set temperature, whereby it is recognized that safety is ensured. This matches the results obtained in JP 2015-026458(A) which is an earlier application. In leak between the S2 and H2 terminals, when the leak resistance becomes equal to or less than 100 KΩ, the input voltage Vi does not reach the set voltage Vref1, and the power control switch SW is not turned OFF by the output from the output port PB1 of the microcomputer U1 unless the temperature becomes a high temperature higher than the set temperature. In addition, when the temperature of the cord-like heating wire 1H becomes high, leak also becomes great, so that positive feedback which changes the power control switch SW to a side where the power control switch SW is not turned OFF is provided to the power control switch SW, leading to an increase in risk of overheating.

Here, when the difference ΔV between the maximum value and the minimum value of the input voltage Vi in Table 1 is seen in the cells at the S2 and H2 terminals, it is recognized that it is possible to prevent overheating even when leak increases, if specifications are set in which a region of ΔV>0.8 V is used as a criterion for overheating and the power control switch SW is turned OFF by output from the output port PB1 of the microcomputer U1. Therefore, when allowance is considered from the temperature control circuit diagram in FIG. 1 and all the data in Table 1, and the cord-like heating wire 1H of the present embodiment is controlled under two conditions, "temperature control is performed based on the maximum value of the input voltage Vi" and "the power control switch SW is turned OFF with the difference ΔV>0.5 V as an overheating range", it is recognized that it is possible to provide a highly safe electric carpet which is able to prevent overheating.

Figure 3:
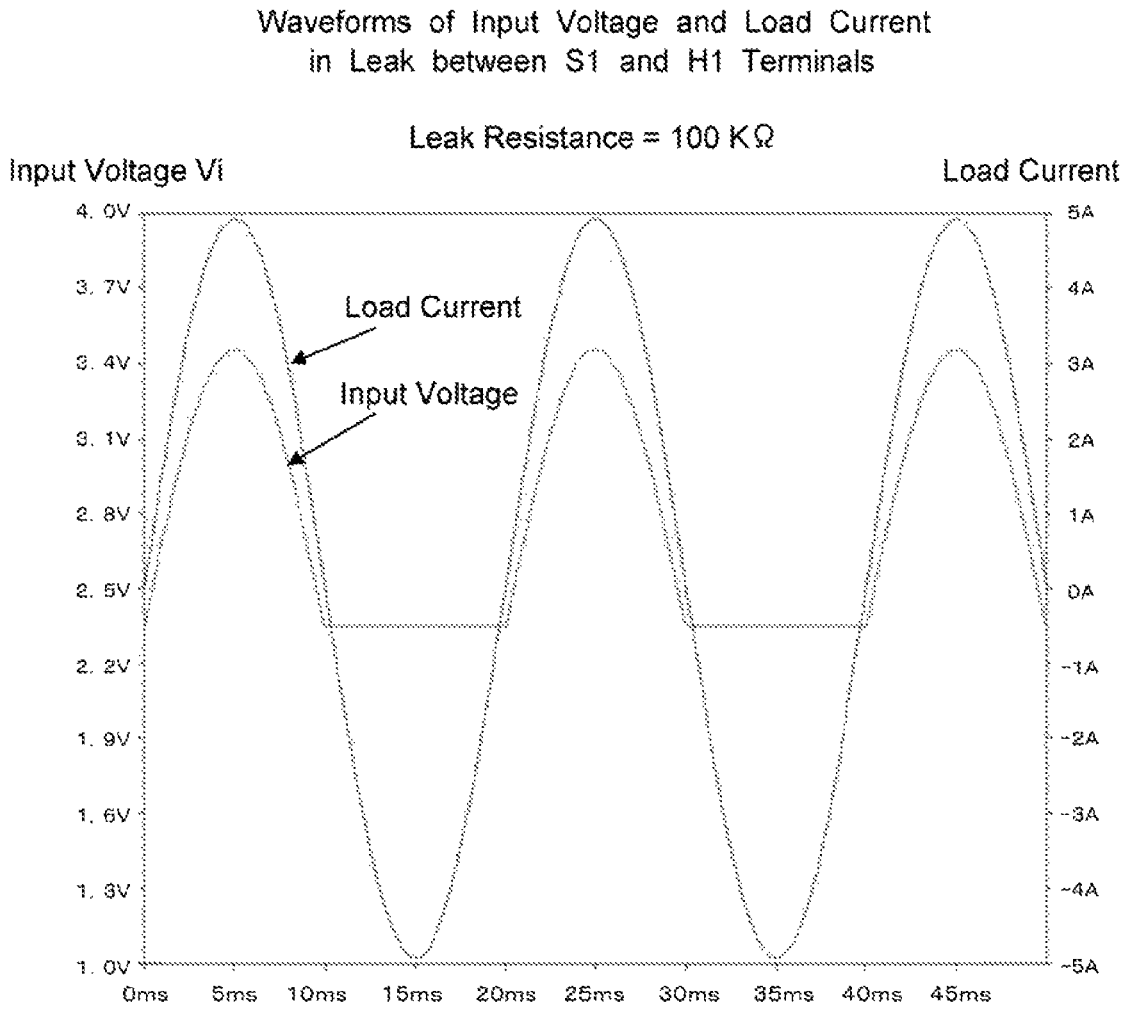
FIG. 3 is a diagram showing the phase of a load current lh and the phase of a voltage Vi inputted to an AD conversion port AD1 of the microcomputer U1 when a power control switch is ON and a leak position is at S1 and H1 terminals, and a leak resistance is 100 KΩ in the warming temperature control device according to the present invention.

According to FIGS. 3, 4 and 5 showing the observed input voltage Vi and load current Ih, an AC component which clearly synchronizes with a load current in accordance with the leak position is superimposed on the input voltage Vi in the case with leak. This is an effect by a combination of the capacitor C1, the diode D1, and the inter-wire short circuit protection circuit added in the present invention, which demonstrates that it is possible to accurately and stably separate a temperature signal and an overheating signal by software means after these signals are inputted to the voltage comparator even without separating these signals in a stage previous to the voltage comparator as in the related art.

[Evaluation of Local Overheating Test]

It is demonstrated that, by incorporating the conditions of "temperature control" and "overheating protection" described in the above [Leak Test] into a control program, even when a strong local insulation operation is performed near the S2 and H2 terminals which are weak against local overheating, a temperature control result which greatly deviates from the set temperature is not obtained, and highly safe temperature control is enabled.

As described above, according to the present invention, while an existing single-wire type cord-like heating wire is used, between both electrodes of a DC stabilization power supply which drives a temperature control section, a fixed resistor with which a capacitor is connected in parallel, a first diode disposed in a forward direction with respect to the power supply, and a temperature detection element wire are connected in series; an inter-wire short circuit protection circuit is included; a voltage of a connection point between the cathode of the first diode and the temperature detection element wire is inputted as an input signal to a voltage comparator; the degree of leak of the polymer layer is determined by detecting the difference between a maximum value and a minimum value of the input signal on a time axis; and the temperature control section performs control such that a heating signal is not outputted when the difference increases to reach a predetermined set value. Thus, it is possible to provide a warming temperature control device which prevents overheating with high accuracy and stability to ensure safety and is excellent in economy.

What is claimed is:

1. A warming temperature control device having a cord-like heating structure comprising:

a first wire which is wound spirally on a winding core at a predetermined pitch;

a polymer layer which is disposed on the first wire in a close-contact manner and melts at a predetermined temperature;

a second wire which is wound spirally on an outer periphery of the polymer layer at a predetermined pitch; and a coating layer which insulates the second wire, wherein one of the first and second wires is composed of a heating element wire, and the other of the first and second wires is composed of a temperature detection element wire;

between both electrodes of a DC stabilization power supply which drives a temperature control section, a fixed resistor with which a capacitor is connected in parallel, a first diode disposed in a forward direction relative to the power supply, and the temperature detection element wire are connected in series;

anodes of second and third diodes are connected to both ends of the temperature detection element wire, respectively;

cathodes of the second and third diodes are connected to one end of a temperature fuse integral type resistor;

another end of the temperature fuse integral type resistor is connected to one side of an AC power supply;

a voltage of a connection point between a cathode of the first diode and the temperature detection element wire is inputted as an input signal to a voltage comparator;

a degree of leak of the polymer layer is determined by detecting a difference between a maximum value and a minimum value of the input signal on a time axis; and when the difference increases to reach a predetermined set value, the temperature control section performs control such that a heating signal is not outputted to prevent overheating to ensure safety.

2. The warming temperature control device according to claim 1, wherein the polymer layer is formed of only a polyamide resin or a mixture of a polyamide resin and polyamide elastomer, and has a melting temperature of not lower than 130° C. and not higher than 190° C.

3. The warming temperature control device according to claim 1, wherein the temperature detection element wire is a metal wire having a positive temperature coefficient.

4. The warming temperature control device according to claim 2, wherein the temperature detection element wire is a metal wire having a positive temperature coefficient.

* * * * *